US010090625B2

(12) United States Patent
Seberger

(10) Patent No.: US 10,090,625 B2
(45) Date of Patent: Oct. 2, 2018

(54) METHOD OF MAKING AN ELECTRICAL TERMINAL

(71) Applicant: Fisher Controls International LLC, Marshalltown, IA (US)

(72) Inventor: Stephen George Seberger, Marshalltown, IA (US)

(73) Assignee: FISHER CONTROLS INTERNATIONAL, LLC, Marshalltown, IA (US)

( * ) Notice: Subject to any disclaimer, the term of this patent is extended or adjusted under 35 U.S.C. 154(b) by 203 days.

(21) Appl. No.: 14/689,563

(22) Filed: Apr. 17, 2015

(65) Prior Publication Data

US 2015/0222069 A1 Aug. 6, 2015

Related U.S. Application Data

(63) Continuation of application No. 13/644,884, filed on Oct. 4, 2012, now Pat. No. 9,033,749.

(Continued)

(51) Int. Cl.
*H01R 43/02* (2006.01)
*H01R 13/187* (2006.01)

(Continued)

(52) U.S. Cl.
CPC ..... *H01R 43/0207* (2013.01); *H01R 4/48* (2013.01); *H01R 4/489* (2013.01); *H01R 12/585* (2013.01);

(Continued)

(58) Field of Classification Search
CPC ..... H01R 4/48; H01R 12/585; H01R 13/187; H01R 13/504; H01R 13/5202;

(Continued)

(56) References Cited

U.S. PATENT DOCUMENTS 4,401,353 A 8/1983 McDevitt, Jr. et al.
4,533,188 A 8/1985 Miniet (Continued)

OTHER PUBLICATIONS

PCT, "Search Report," issued in connection with International Patent Application No. PCT/US2012/059215, dated Jan. 2, 2013 (3 pages).

(Continued)

*Primary Examiner* — Paul D Kim
(74) *Attorney, Agent, or Firm* — Hanley, Flight & Zimmerman, LLC

(57) ABSTRACT

Electrical terminals and methods of manufacturing the same are disclosed. An example method of making an electrical terminal is disclosed that includes forming a base portion of a housing for the electrical terminal, forming a top portion of the housing, the top portion having an opening defining an entry point for a wire to be terminated, extending a connector pin out through a bottom surface of the base portion of the housing to enable electrical connection with a printed circuit board, and sealingly mating the top portion to the base portion to enclose a first wire clamp within the housing, the first wire clamp to secure the wire in electrical contact with the connector pin when the wire is extending into the housing through the opening, the base portion and the top portion being immovably affixed, wherein the first wire clamp is actuated by a screw.

22 Claims, 5 Drawing Sheets

Related U.S. Application Data

(60) Provisional application No. 61/544,084, filed on Oct. 6, 2011.

(51) Int. Cl.

| | |
|---|---|
| ***H01R 4/48*** | (2006.01) |
| ***H01R 12/58*** | (2011.01) |
| ***H01R 43/00*** | (2006.01) |
| *H01R 13/504* | (2006.01) |
| *H01R 13/52* | (2006.01) |
| *H01R 12/50* | (2011.01) |

(52) U.S. Cl.
CPC ..... *H01R 13/187* (2013.01); *H01R 43/005* (2013.01); *H01R 43/0256* (2013.01); *H01R 13/504* (2013.01); *H01R 13/521* (2013.01); *H01R 13/5202* (2013.01); *H01R 23/688* (2013.01); *Y10T 29/4921* (2015.01); *Y10T 29/49208* (2015.01); *Y10T 29/49211* (2015.01)

(58) Field of Classification Search
CPC ..... H01R 13/521; H01R 43/0256; Y10T 29/53022; Y10T 29/53196; Y10T 29/53235; Y10T 29/5327
USPC ..... 29/876–878; 439/851–853, 884–887
See application file for complete search history.

(56) References Cited

U.S. PATENT DOCUMENTS

| | | | | |
|---|---|---|---|---|
| 4,713,020 | A * | 12/1987 | Awano | H01R 4/50 439/267 |
| 4,759,726 | A | 7/1988 | Naylor et al. | |
| 4,921,439 | A | 5/1990 | Bofill et al. | |
| 4,981,432 | A | 1/1991 | Kikuchi | |
| 6,428,343 | B1 | 8/2002 | Landis et al. | |
| 6,965,671 | B2 | 11/2005 | Kao et al. | |
| 7,347,739 | B2 * | 3/2008 | Cox | H01R 4/38 439/709 |
| 7,979,984 | B2 * | 7/2011 | Chen | H05B 33/0803 29/825 |
| 2008/0045065 | A1 | 4/2008 | O'Connor | |
| 2011/0086525 | A1 | 4/2011 | Begemann et al. | |
| 2013/0090024 | A1 | 4/2013 | Seberger | |

OTHER PUBLICATIONS

PCT, "Written Opinion," issued in connection with International Patent Application No. PCT/US2012/059215, dated Jan. 2, 2013 (7 pages).

United States Patent and Trademark Office, "Non-Final Office action", issued in connection with U.S. Appl. No. 13/644,884, dated Jan. 8, 2014, 15 pages.

United States Patent and Trademark Office, "Final Office action", issued in connection with U.S. Appl. No. 13/644,884, dated Apr. 11, 2014, 10 pages.

United States Patent and Trademark Office, "Advisory action", issued in connection with U.S. Appl. No. 13/644,884, dated Jun. 19, 2014, 2 pages.

United States Patent and Trademark Office, "Non-Final Office action", issued in connection with U.S. Appl. No. 13/644,884, dated Jul. 23, 2014, 13 pages.

United States Patent and Trademark Office, "Non-Final Office action", issued in connection with U.S. Appl. No. 13/644,884, dated Oct. 24, 2014, 13 pages.

United States Patent and Trademark Office, "Notice of Allowance", issued in connection with U.S. Appl. No. 13/644,884, dated Feb. 6, 2015, 15 pages.

* cited by examiner

METHOD OF MAKING AN ELECTRICAL TERMINAL

RELATED APPLICATION

This patent is a continuation of U.S. patent application Ser. No. 13/644,884, filed on Oct. 4, 2012, now U.S. Pat. No. 9,033,749, which claims the benefit of U.S. Provisional App. Ser. No. 61/544,084, filed on Oct. 6, 2011, both of which are incorporated herein by reference in their entireties.

FIELD OF THE DISCLOSURE

This disclosure relates generally to electrical connectors and, more particularly, to electrical terminals and methods of manufacturing the same.

BACKGROUND

Electrical terminal blocks or just terminals are electrical connectors that facilitate the connecting of individual electrical wires to other wires and/or external circuits. Terminals are used widely in many industries because of their versatility in connecting various sizes, types (e.g., solid-core vs. stranded wire), and/or number of wires. There are many different terminal designs that may be used to securely hold and establish an electrical connection to a wire. For example, some terminals may accept wires prepared with ring or spade terminal lugs on their ends. Other terminals may secure the stripped end of a wire with a metal clamp that is manually actuated by a screw. Yet other terminals may clamp a wire in place via a spring force that may be actuated manually or automatically.

There are also differing methods to connect one terminal to another and/or to external circuits. For example, multiple terminals may be mounted to a common base (e.g., a DIN rail) to secure the terminals relative to one another and then connected with various connecting pieces (e.g., bridge bars) designed to engage and connect individual terminals. Other terminals are designed to mount directly to a printed circuit board via pins soldered directly into the printed circuit board to establish the desired electrical connection(s).

SUMMARY

Electrical terminals and methods of manufacturing the same are disclosed. An example terminal comprises a housing and a wire clamp positioned within the housing to secure a wire in electrical contact with a connector pin, the connector pin extending out a bottom surface of the housing to be electrically connected to a printed circuit board, the housing is to have one or more feet to separate the bottom surface of the housing from the printed circuit board.

Another example terminal comprises a body having an opening to receive an end of a wire, a wire holder within the body to secure the end of the wire, a connector pin extending out a bottom surface of the body to be electrically connected to a circuit board, where the wire holder is to secure the end of the wire in electrical connection with the connector pin, the body comprises a spacer extending out the bottom surface of the body adjacent the connector pin to provide a space between the bottom surface of the body and the circuit board.

Another example terminal comprises a housing having an opening to receive an end of a wire, a first connector pin extending out from a bottom surface of the housing via a hole in the bottom surface of the housing, the connector pin to connect to a circuit board via a solder joint, a first clamp enclosed by the housing to secure the end of the wire in electrical contact with the first connector pin, and a riser extending from the bottom surface of the housing to raise the bottom surface of the housing away from the circuit board to enable access beneath the housing around the solder joint.

DETAILED DESCRIPTION

Figure 1A:
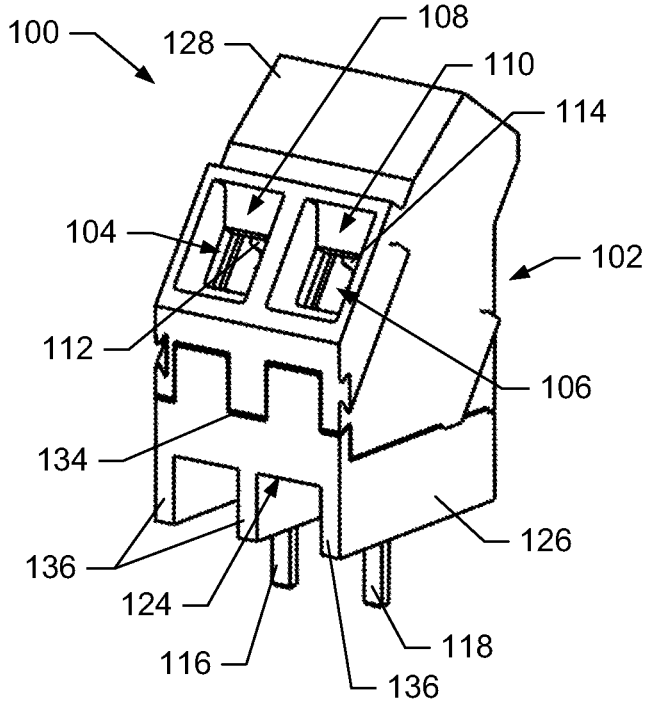
FIG. 1A is an isometric diagram of an example two-wire terminal in accordance with the teachings disclosed herein.
Figure 1B:
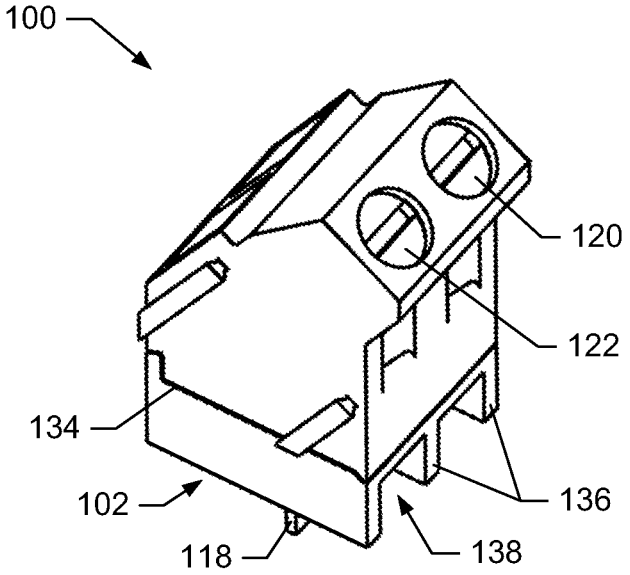
FIG. 1B is an isometric diagram of a different angle of the example terminal of FIG. 1A.
Figure 1D:
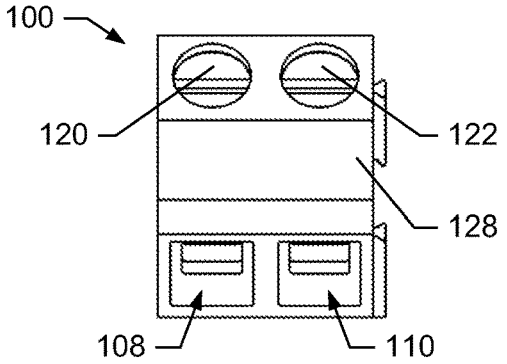
FIG. 1D is a top view of the example terminal of FIG. 1A.
Figure 1C:
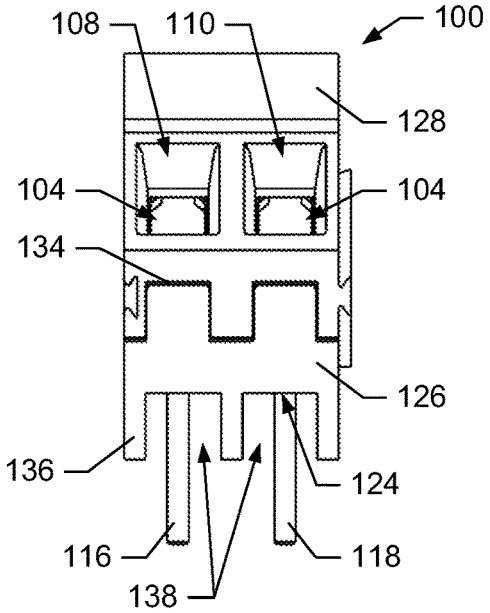
FIG. 1C is a front view of the example terminal of FIG. 1A.
Figure 1F:
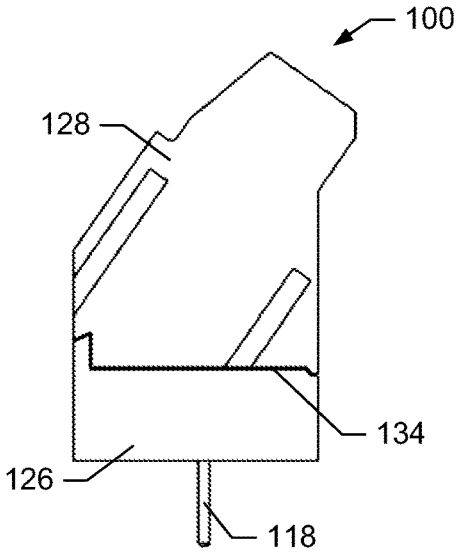
FIG. 1F is a side view of the example terminal of FIG. 1A.
Figure 1E:
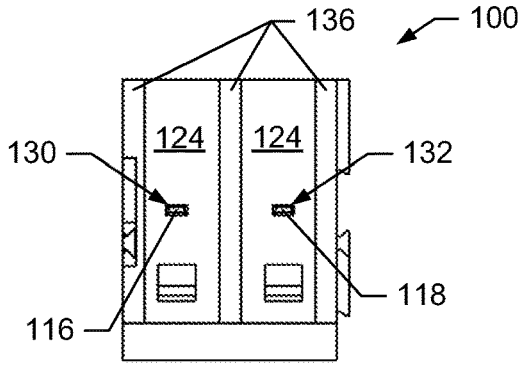
FIG. 1E is a bottom view of the example terminal of FIG. 1A.

FIGS. 1A and 1B are isometric diagrams of an example two-wire terminal 100. FIGS. 1C-1F are diagrams of front, top, bottom, and side views, respectively, of the terminal 100. In some examples, the terminal 100 has a plastic body or housing 102 to enclose internal mechanisms that enable an end of a wire to be connected with other electrical components (e.g., other terminals, a printed circuit board, etc.). For example, the internal mechanism of a terminal may include a wire holder such as a clamp, cage, spring, etc, to hold a wire in place and maintain the wire in electrical contact with an electrical lead or pin that can be electrically connected with the other electrical components.

A terminal may be constructed to enable the connection of one or more wires. For example, as shown in the illustrated examples, the terminal 100 has two wire entry points, apertures, or openings 104, 106, corresponding to two separate wire termination points 108, 110 for two separate wires. Each wire position 108, 110 may contain a corresponding internal mechanism to receive a bare end of a wire and secure it to be electrically connected to other components connected with the terminal 100. In particular, the illustrated examples in FIGS. 1A-1F are representative of an example cage clamp terminal but other types of terminals may be suitably adapted in accordance with the teachings disclosed herein. Accordingly, as illustrated in FIGS. 1A-1F, each internal mechanism of the example terminal 100 contains a corresponding cage 112, 114 enclosed within the housing 102 to receive and clamp a corresponding end of a wire in electrical contact with a corresponding metal surface that is electrically connected to a corresponding connector pin 116, 118. In such examples, each cage 112, 114 is actuated by a corresponding screw 120, 122. In some examples, the connector pin 116, 118 extends away from a bottom surface 124 of the housing 102 and may be electrically connected to other electrical components such as, for example, by soldering the protruding end of the connector pins 116, 118 to a printed circuit board.

Unlike many known cage clamp terminal bodies or housings, which are formed from a single piece of material (i.e., are unitary) and which have an opening in the bottom to insert the internal mechanisms, the housing 102 of the example terminal 100 is made of a base or bottom portion 126 and a separate cap or top portion 128. The base portion 126 includes holes 130, 132 in the bottom surface 124 through which the pins 116, 118 may be inserted. Other than the holes 130, 132, the base portion 126 is closed off on the bottom surface 124. In some examples, each hole 130, 132 is substantially fitted (e.g., sized for a press-fit) to the respective connector pin 116, 118 to reduce the possibility of external materials entering the housing 102 via the bottom of the housing 102 and causing an electrical leakage path.

After the internal mechanisms (e.g., the cages 112, 114) are inserted into the base portion 126 with the connector pins 116, 118 extending out through the holes 130, 132, the top portion 128 is placed on the base portion 126 over the internal mechanisms. In the illustrated examples, the base and top portions 126, 128 are shaped to securely mate with each other along a seam 134, thereby completely enclosing the internal mechanisms of the example terminal 100. In some examples, the base and top portions 126, 128 may be sealingly mated along the seam 134 via ultrasonic welding to bond the base and top portions 126, 128 and achieve a tight seal around the internal mechanisms of the terminal 100. In this manner, the potential for contaminants from an external environment ingressing, via the interfacing surfaces of the base and top portions 126, 128, and disrupting the electrical connections established via the terminal 100 is reduced. Additionally or alternatively, a tight seal may be accomplished via an over-molding process, in which a separate piece is attached with an adhesive and/or a sealant and/or via any other suitable method.

In addition to a sealing joint along the seam 134 around the exterior of the housing 102, in some examples, the mated base and top portions 126, 128 form an internal wall that extends between the wire termination points 108, 110. In this way, the internal mechanisms (e.g., the cages 112, 114) of the example terminal 100 may not only be substantially isolated from an outside environment (and any associated contaminants) surrounding the bottom and/or sides of the housing 102, but each internal mechanism may also be isolated from the other internal mechanisms. The separation of the internal mechanisms serves to reduce (e.g., prevent) the potential for corrosion and/or an electrical leakage path from developing between the two wire termination points 108, 110 from trapped moisture and/or contaminants resulting in an undesirable and/or unexpected electrical connection. As described above, the bonding of the base and top portions 126, 128 to form the internal wall may be accomplished via ultrasonic welding, an adhesive, and/or any other suitable method.

Furthermore, in some examples, the terminal 100 may include one or more feet, risers, or spacers 136 extending from the bottom surface 124 of the housing 102 to raise the terminal 100 and provide a space or gap 138 between the bottom surface 124 of the terminal 100 and a printed circuit board (not shown) to which the connector pins 116, 118 may be soldered. In such examples, the gap 138 enables access to the solder joints to encapsulate the printed circuit board including the solder joints to achieve environmental exclusion. Additionally, such an encapsulation process may be performed without concern for the encapsulant entering the housing 102 of the terminal 100 and potentially affecting the internal mechanisms because the bottom surface 124 of the housing 102 is closed except for where the connector pins 116, 118 extend through the holes 130, 132 of the bottom surface 124. Furthermore, the holes 130, 132 may be sized to provide a tight fit (e.g., a press-fit, an interference fit, etc.) around the connector pins 116, 118 to reduce the possibility of encapsulant (or other contaminants) around the bottom of the housing 102 from entering the terminal 100, especially where the encapsulant has a high viscosity. In addition, an over-molding process would achieve an even tighter seal between the connector pins 116, 118 and the holes 130, 132.

Additionally or alternatively, the gap 138 created by the feet 136, in the illustrated example, also enables access to the solder joints for more effective cleaning, thereby reducing the chance of accumulation of contaminants and/or corrosion. As a result, the example terminal 100 may last significantly longer without replacement and/or provide substantially increased reliability and/or may be used in less benign environments (e.g., corrosive atmospheres and/or high temperature and humid environments) than many known terminal blocks. Additionally, even when cleaning is not frequently performed, the feet 136 of the illustrated example may also serve as a wall to at least partially isolate the adjacent connector pins 116, 118 from each other, thereby reducing the possibility of an electrical leakage path developing between the pins 116, 118 from moisture and/or contamination build up. Similarly, the example feet 136 may also serve as a wall to separate the connector pins 116, 118 from other adjacent circuitry (e.g., circuitry on a printed circuit board).

While the feet 136 are shown in the illustrated examples of FIGS. 1A-1F as being rectangular, the feet 136 may be circular or have any other suitable cross-section. Similarly, while the example feet 136 shown in FIGS. 1A-1F are straight, the feet 136 may be curved, joined at one end, or positioned in any other suitable manner in accordance with the teachings of this disclosure. Furthermore, the height of the feet 136 (and, therefore, the height of the gap 138) may be of any suitable dimension.

Figure 2:
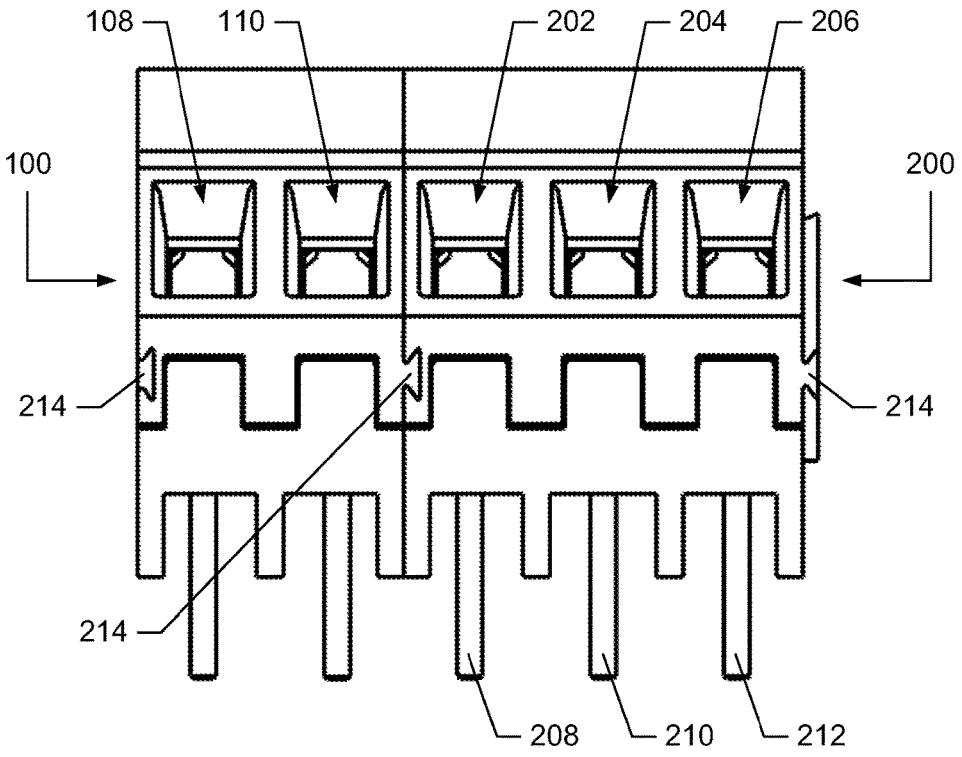
FIG. 2 is a schematic diagram of an example three-wire terminal mated with the example two-wire terminal of FIG. 1A.

FIG. 2 is a schematic diagram of an example three-wire terminal 200 mated with the example terminal 100 of FIG. 1A. The example three-wire terminal 200 is similar in design and function as the example two-wire terminal 100 discussed above in connection with FIGS. 1A-1F. However, the three-wire terminal 200 has three wire termination points 202, 204, 206 and three corresponding internal mechanisms (e.g., cages) connected to respective connector pins 208, 210, 212 rather than the two wire termination points 108, 110 in the two-wire terminal 100. In the illustrated example, the terminals 100, 200 are mated via bracket connectors 214 (e.g., dove-tail type connectors) formed on either side of the terminals 100, 200. In this manner, any suitable number of wire termination points may be aligned using any suitable number of terminals. Furthermore, while multiple terminals (e.g., the example terminals 100, 200) may be mated side-by-side, in other examples, a single terminal may be formed in accordance with the teachings disclosed herein comprising any suitable number of wire termination points, including terminals with only a single wire position.

In addition to the number of wire termination points 108, 110, 202, 204, 206, a terminal constructed in accordance with the teachings disclosed herein may vary in other respects as well. For example, the angle of the screws 120, 122 and wire entry points 104, 106 can be varied relative to one another and/or relative to the surface of the printed circuit board. The dimensions and/or size of the terminals and corresponding components may be appropriately varied.

Furthermore, as previously stated, the feet 136 as well as the two-part body 102 to enclose the internal mechanisms of a terminal may be incorporated into different types of terminals other than cage clamp terminals.

Figure 3:
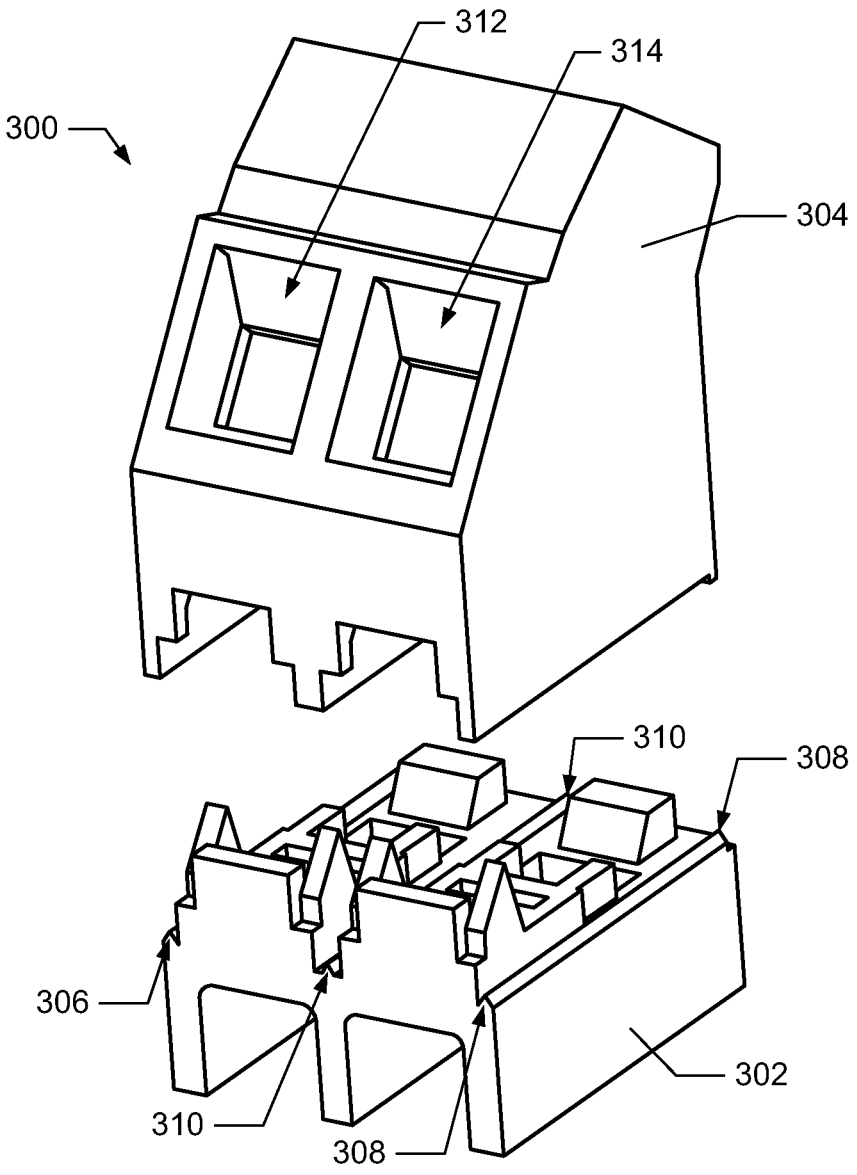
FIG. 3 is an exploded view of an example housing for another example two-wire terminal according to the teachings disclosed herein.

FIG. 3 is an exploded view of an example housing 300 of an example two-wire terminal having a base portion 302 and a top portion 304 similar to the housing 102 of the example terminal 100 described above in connection with FIGS. 1A-F. As shown in the illustrated example of FIG. 3, the base portion 302 includes triangular shaped weld lines 306, 308 along portions of the perimeter of the base portion 302. In the illustrated example, the weld lines 306, 308 provide excess plastic that may be melted during an ultrasonic welding process to bond the base portion 302 to the top portion 304 and form a seal around the internal mechanisms to be enclosed within the housing 300. While the weld lines 306, 308 are shown spanning opposites sides of the base portion 302, other weld lines may be located at other locations along the perimeter of the base portion 302 to achieve the desired sealing bond when the base and top portions 302, 304 are mated. Furthermore, the illustrated example of FIG. 3 shows another weld line 310 spanning the center of the base portion 302. In this manner, when the base and top portions 302, 304 of the example housing 300 are mated during the ultrasonic welding process, they may form an internal wall that is tightly sealed between the internal mechanisms for each of two wire termination points 312, 314 illustrated in FIG. 3. In other examples, additional weld lines may be placed on the top portion 304 instead of, or in addition to, the weld lines 306, 308, 310 located on the base portion 302.

Figure 4:
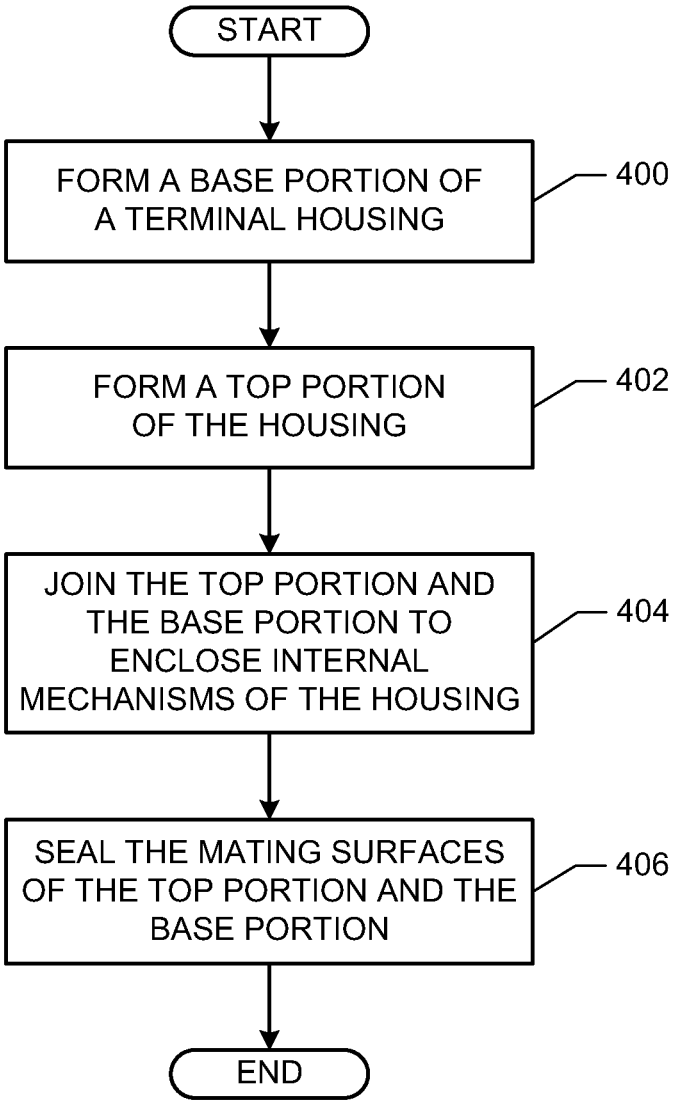
FIG. 4 is a flow chart representative of an example process that may be carried out to manufacture the example electrical terminals described herein.

FIG. 4 is a flowchart representative of an example process to manufacture any of the example electrical terminals disclosed herein. Although the example process of FIG. 4 is described with reference to the flowchart of FIG. 4, many other methods of implementing the example process of FIG. 4 may be employed. For example, the order of execution of certain blocks may be changed, and/or some of the blocks described may be changed, eliminated, sub-divided, or combined.

The example process of FIG. 4 begins by forming a base portion of a terminal housing (block 400). The base portion may be made of plastic and, therefore, formed via an injection molding process or any other suitable method. The shape of the base portion may be formed so as to hold internal mechanisms (e.g., clamp, cage, spring, etc.) within the terminal. As described above, the internal mechanisms may be employed to secure a wire in electrical connection with corresponding connector pins, which may be used to then electrically connect the wire to other electrical components (e.g., a printed circuit board). In some examples, the base portion is formed with a closed off bottom surface except for holes through which the connector pins may extend.

The example process of FIG. 4 further includes forming a top portion of the terminal housing (block 402). The top portion may be formed in a similar manner to the base portion such that the shape of the top portion fits over the internal mechanism and may be mated with the base portion. In this manner, the top and base portions of the terminal housing may enclose the internal mechanisms. Although surrounding the internal mechanisms, the top portion may contain an opening or aperture through which an end of wire may be fed and received by the internal mechanisms. In some examples, the terminal is to include more than one wire termination points. In such examples, both the base portion and the top portion may be formed such that when they are joined around the internal mechanisms, the base and top portions form an internal wall separating each internal mechanism corresponding to each wire termination point.

With the base and top portions thus formed, the example process then joins the base and top portion to enclose the internal mechanisms (block 404). Additionally, the example process involves sealing the mating surface of the top portion and the base portion (block 406). In some examples, the sealing process may include ultrasonic welding. In such examples, when the base portion and/or the top portion are formed (blocks 400, 402), the mating surfaces may include one or more weld lines defined by an excess portion of plastic to be melted and provide a tight seal between the top and base portions. Such an example may apply to the exterior perimeter of the terminal or to an internal wall when there is more than one wire termination point. The seal along the perimeter of the terminal helps to reduce the chance for contaminants, moisture, or encapsulant from the outside environment from entering the housing through the interface between the base and top portions while the seal along an internal wall serves to reduce the possibility of corrosion and/or an electrical leakage path from developing between adjacent internal mechanisms. Additionally or alternatively, the base portion and the top portion may be sealed (block 406) via any other suitable process such as an over-molding process, an adhesive, a sealant, etc. Once the base portion and the top portion have been sealingly mated, the example process of FIG. 4 ends.

Although certain example methods, apparatus and articles of manufacture have been described herein, the scope of coverage of this patent is not limited thereto. Such examples are intended to be non-limiting illustrative examples. On the contrary, this patent covers all methods, apparatus and articles of manufacture fairly falling within the scope of the appended claims either literally or under the doctrine of equivalents.

The Abstract included herewith is provided to comply with 37 C.F.R. § 1.72(b) to allow the reader to quickly ascertain the nature of the technical disclosure. It is submitted with the understanding that it will not be used to interpret or limit the scope or meaning of the claims.

What is claimed is:

1. A method of making an electrical terminal comprising:

forming a base portion of a housing for the electrical terminal;

forming a top portion of the housing, the top portion having an opening defining an entry point for a wire to be terminated, the top portion formed with a protrusion extending therefrom to mate with the base portion at an interface that extends between holes in the base portion through which first and second connector pins are to extend, at least one of the base portion or the top portion formed with a weld line of excess material disposed at the interface, the weld line to be melted during ultrasonic welding;

extending the first connector pin out through a bottom surface of the base portion of the housing to enable electrical connection with a printed circuit board; and sealingly mating the top portion to the base portion via the ultrasonic welding to enclose first and second wire clamps within the housing, the first wire clamp to secure the wire in electrical contact with the first connector pin when the wire is extending into the housing through the opening, the base portion and the top portion being immovably affixed, wherein the first wire clamp is actuated by a screw, the base portion having one or more feet extending from a front face of the base portion to a back face of the base portion, at least one of the feet positioned between the first connector pin associated with the first wire clamp and the second connector pin associated with the second wire clamp.

2. The method of claim 1, wherein the bottom surface of the housing is substantially sealed around the first and second connector pins to substantially prevent at least one of contaminants, moisture, or encapsulant from entering the housing.

3. The method of claim 1, wherein the one or more feet are positioned adjacent the first connector pin to reduce a possibility of an electrical leakage path developing between the first connector pin and adjacent circuitry on an opposite side of the one or more feet when the first connector pin is connected to the printed circuit board.

4. The method of claim 1, wherein the base portion and the top portion form a wall at the interface to separate the first and second wire clamps.

5. The method of claim 4, further comprising sealingly mating the base portion and the top portion at the interface to substantially isolate the first wire clamp from the second wire clamp.

6. The method of claim 4, wherein the wall extends from the front face of the base portion to the back face of the base portion.

7. The method of claim 1, wherein the top and base portions of the housing are sealed via at least one of over-molding, an adhesive, or a sealant.

8. The method of claim 1, wherein the electrical terminal is a cage clamp terminal.

9. The method of claim 1, wherein the top portion includes a first planar surface surrounding an end of the screw and a second planar surface surrounding the opening defining the entry point for the wire, the first planar surface to be angled relative to the front face of the base portion and the bottom surface of the base portion, the second planar surface to be angled relative to the front face of the base portion and the bottom surface of the base portion.

10. The method of claim 1, wherein a front face of the top portion is coplanar with the front face of the base portion when the top portion and the base portion are mated together.

11. The method of claim 10, wherein the front face of the base portion and the front face of the top portion include interlocking flanges.

12. The method of claim 11, wherein at least one of the feet partially defines the front face of the base portion together with the interlocking flanges.

13. The method of claim 1, wherein the weld line extends from the front face of the base portion to the back face of the base portion.

14. The method of claim 1, wherein at least one of the feet is aligned with the weld line and the protrusion when the base portion and the top portion are mated together.

15. The method of claim 1, wherein the one or more feet have a consistent width along a height of the one or more feet extending from a bottom surface to a distal end of the base portion, the height being at least two and a half times larger than the width.

16. A method of making an electrical terminal, comprising:

forming a base portion of a housing for the electrical terminal;

forming a top portion of the housing, the top portion having an opening defining an entry point for a wire to be terminated, the top portion formed with a protrusion extending therefrom to mate with the base portion via a weld line of excess material disposed on at least one of the base portion or the protrusion of the top portion, the weld line extending between holes through which first and second connector pins are to extend;

inserting first and second wire clamps between the base portion and the top portion of the housing, the first wire clamp actuated via a screw to secure the wire in electrical contact with the first connector pin when the wire is inserted through the opening for termination; and mating the base portion to the top portion to enclose the first wire clamp via ultrasonic welding, the base portion and the top portion being immovably affixed, the base portion having one or more feet extending from a front face of the base portion to a back face of the base portion, at least one of the feet positioned between the first connector pin associated with the first wire clamp and the second connector pin associated with the second wire clamp.

17. The method of claim 16, wherein a bottom surface of the base portion is solid except for the holes through which the first and second connector pins extend to substantially prevent at least one of contaminants, moisture, or encapsulant from entering the housing.

18. The method of claim 16, wherein the base portion and the top portion form an internal wall separating the first and second wire clamps.

19. The method of claim 18, further comprising sealingly mating the base portion and the top portion at the wall to substantially isolate the first wire clamp from the second wire clamp.

20. The method of claim 16, wherein the weld line is one of a plurality of weld lines, the method further comprising forming at least one of the base portion or the top portion of the housing with additional ones of the plurality of weld lines along a perimeter of the at least one of the base portion or the top portion, the plurality of weld lines to be melted during the ultrasonic welding to sealingly bond the top and base portions of the housing.

21. A method of making an electrical terminal, comprising:

forming a base portion of a housing for the electrical terminal;

forming a top portion of the housing, the top portion having an opening defining an entry point for a wire to be terminated, the top portion formed with a protrusion extending therefrom to mate with the base portion at a location defined by a weld line of excess material to be melted during ultrasonic welding, at least one of the base portion or the top portion formed with the weld line disposed thereon, the weld line oriented to extend in a direction passing between holes through which first and second connector pins are to extend;

extending the first connector pin through one of the holes that is disposed on a bottom surface of the base portion;

inserting first and second wire-holders between the base portion and the top portion of the housing, the first wire-holder to secure an end of the wire in electrical contact with the first connector pin, wherein the first wire-holder is actuated via a screw; and bonding the top portion to the base portion via the ultrasonic welding to sealingly enclose the first wire-holder along mating surfaces of the top and base portions, the base portion having one or more feet extending from a front face of the base portion to a back face of the base portion, at least one of the feet positioned between the first connector pin associated with the first wire-holder and the second connector pin associated with the second wire-holder.

22. The method of claim 21, wherein the base portion and the top portion form an internal wall separating the first and second wire-holders.

* * * * *